US005125258A

United States Patent [19]

Warner

[11] Patent Number: 5,125,258

[45] Date of Patent: Jun. 30, 1992

[54] METHOD AND TOOLS FOR FORMING SHEET METAL

[76] Inventor: Richard L. Warner, 17301 Polk Street N.E., Anoka, Minn. 55303

[21] Appl. No.: 678,060

[22] Filed: Apr. 1, 1991

Related U.S. Application Data

[62] Division of Ser. No. 299,892, Feb. 23, 1989, Pat. No. 5,024,076.

[51] Int. Cl.[5] ..... B21D 53/80

[52] U.S. Cl. ..... 72/379.2; 52/244

[58] Field of Search ..... 98/67; 52/219, 244, 52/300; 72/379.2

[56] References Cited

U.S. PATENT DOCUMENTS

| | | | |
|---|---|---|---|
| 957,544 | 5/1910 | Canivan | 52/244 |
| 3,168,780 | 2/1965 | Breidert | 72/379.2 |
| 4,970,837 | 11/1990 | Fogelstrom | 52/244 |

*Primary Examiner*—Lowell A. Larson
*Attorney, Agent, or Firm*—Sten Erik Hakanson

[57] ABSTRACT

The present invention concerns a method and tools for forming sheet metal, and in particular, a method for making a chase top from a stock rectangular piece of sheet metal. Creasing tools are described that each have a handle member and a creasing wheel suspended therefrom cooperates with a support lip to form first and second crease lines and first and second flange areas along each perimeter edge of the workpiece. A reinforcing ridge tool is shown having a handle member with a wheel rotatively suspended therefrom is used to indent the sheet metal along desired lines inwardly of the crease lines to form reinforing ridges. A bending tool is described having cooperating bending members for clamping the workpiece along each second crease line for bending the workpiece there along to form vertical wall portions.

15 Claims, 4 Drawing Sheets

Fig. 9
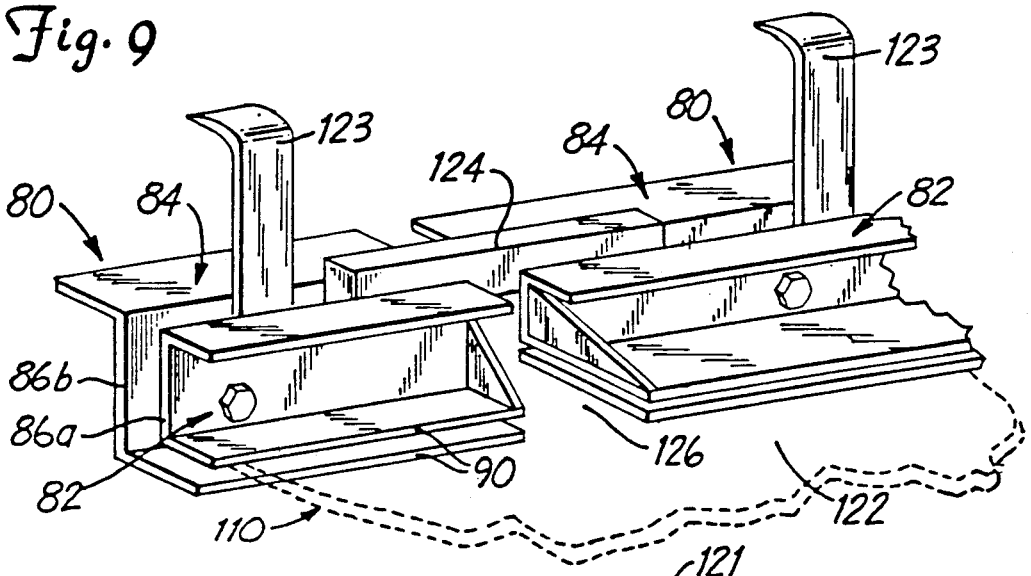
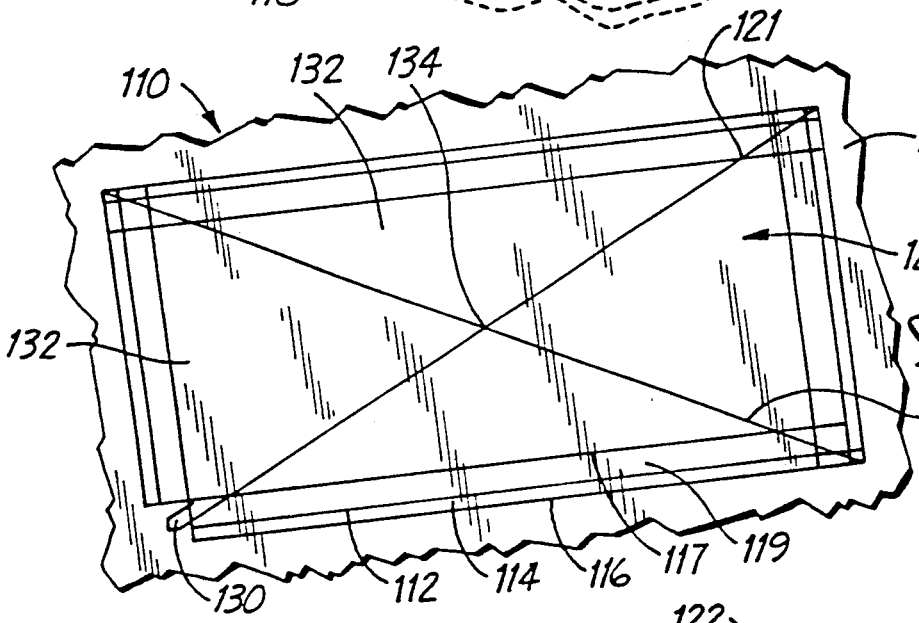
Fig. 10
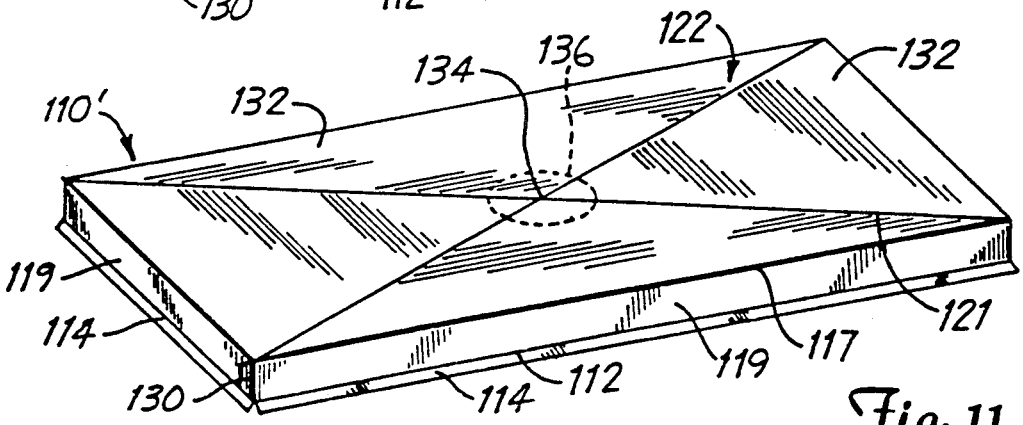
Fig. 11

METHOD AND TOOLS FOR FORMING SHEET METAL

BACKGROUND OF THE INVENTION

This application is a co-pending divisional application based upon U.S. Ser. No. 07/299,892 filed Feb. 23, 1989, now U.S. Pat. No. 5,024,076 granted Jun. 18, 1991.

1. Field of the Invention

The present invention relates generally to methods and hand tools for forming sheet metal, and the like, and more specifically to such methods and hand tools for forming chase tops for chimney flue installations.

2. Prior Art

Modern fireplace installations typically include the use of a galvanized metal flue in place of the traditional, but much more costly, use of mortar and brick. However, as such a metal flue is not generally aesthetically pleasing it is generally placed within a rectangular housing that includes an exterior facade of brick or other desirable material to simulate the traditional chimney appearance. Thus, at the top of an installation of this type, a rectangular cover or "chase top", also consisting of galvanized sheet metal, is placed to cap off the chimney and prevent the entrance of water and so forth in the space between the metal flue and the rectangular housing. A chase cap will include an angled top surface having a hole through which the flue can extend, and four perimeter edges extending downwardly at substantially right angles to the top surface and terminating with a skirt or drip edges. In this manner rain will run off the top and drip from the edges to the roof of the structure. Also, the top surface will include reinforcement ridges for making the top stronger and less susceptible to deformation by wind which can cause unwanted noise and metal fatigue.

Chase tops are generally made by forming a flat rectangular piece of sheet metal using large and expensive bending and forming machines. Thus, such construction, of necessity, takes place at a factory location away from the job site. As a result thereof, substantial expense is incurred, primarily in labor time, driving back and forth from the job site to the place of manufacture of the top. In addition, since the construction of the flue housing will be accomplished first, there can be a period of time during which the chimney housing will remain open and susceptible to weather damage prior to installation of the top.

Attempts at making the top at the job site have not been very successful. Such attempts involve the use of conventional hand tools such as hammers, and the like, and have resulted in inferior looking tops having rippled and otherwise unclean lines of bending, and poor fit. Also, it has proven difficult to provide for the reinforcement ridging of the top surface area of the chase top.

Therefore, it would be very desirable to be able to manufacture chase tops at the job site immediately as needed, and do so in a manner that equals the quality of the factory manufactured top, yet at less cost.

SUMMARY OF THE INVENTION

The objects and advantages of the present invention include, but are not limited to the following:

1. To provide hand tools for forming sheet metal.

2. To provide for the reinforcement ridging of sheet metal.

3. To provide for the clean bending of sheet metal along a give line.

4. To provide for the skirting or slight bending of sheet metal along a given line.

5. To provide for a such hand tools that are simple in design, reliable and easy to use.

6. To provide for a method of using such hand tools for the manufacture of chase tops.

7. To provide for such a method that is easy to learn and that can be performed at the job site.

8. To provide for such a method that minimizes the amount of labor time involved in the installation of a chase top.

The present invention concerns a method and tools for forming sheet metal. The hand tools of the invention herein include generically, a skirting or creasing tool, a reinforcing ridge making tool, and a bending tool.

The creasing tool includes first and second handle members held in a spaced apart relationship by a plurality of bolts along the lengths thereof. A hardened steel cutting disk is rotatively secured between the handle members on one of the bolts extending there between. The first handle member includes a sheet metal support lip extending therefrom towards the second member and terminating adjacent the perimeter of the disk and the plane of extension thereof.

The reinforcing ridge making tool also includes first and second handle members held in a spaced apart relationship by a plurality of bolts or spacing members along the lengths thereof. A hardened steel cutting disk is rotatively secured between and centrally of the handle members on one of the spacing bolts extending there between. A portion of the disk extends below the bottom surfaces of the handle members.

The bending tool includes two elongate L-shaped or angle iron clamping pieces, each piece having a lower horizontal portion and a vertical portion integral therewith and extending upwardly therefrom. The first or lower member includes a plurality of stops integral therewith on the top surface of the lower horizontal portion thereof, and a pair of elongate rounded fulcrum portions integral with the inner surface of the vertical portion thereof. The two clamping pieces are nestled together in a coordinate fashion wherein their vertical and horizontal portions extend in similar directions. The clamping pieces are held together in a flexible fashion by a plurality of spring biased fasteners secured to and extending between the vertical portions thereof. The fasteners are designed to bias the clamping ends together and maintain the L-shaped members in a proper orientation.

The method of making a chase top according to the present invention is accomplished by the use of the above described hand tools to form a flat piece of an appropriate sheet metal stock. Typically, such a piece of metal is rectangular having two long sides and two shorter ends. The sheet metal is first and preferably laid on a clean flat surface. A first creasing tool is extended around the perimeter of the metal sheet along each of the four sides. Specifically, the bottom of each perimeter edge is held by the support lip whereby the cutting wheel is pressed against the top surface of the sheet metal a distance inwardly of the perimeter edge approximately equaling the width of the support lip. Further wheel pressure is applied by slightly rotating the creasing tool about an axis along its length in a direction away from the perimiter edge. Extending the creasing tool along each edge, while simultaneously rotating it, results in a straight crease along each of the edges and results in that portion of the sheet metal from the crease outwardly to the respective edge to bend slightly in an upward direction with respect to the ground or flat surface upon which the sheet metal is laid.

The sheet metal is then preferably turned over and laid on its opposite surface to facilitate the next step wherein a second creasing tool is used. The second creasing tool is used in the same manner as described above for the first creasing tool. However, the second creasing tool has a wider support lip than the first, and therefore, causes a crease line to be made along each edge in a manner further inwardly on the sheet metal from each respective perimeter edge thereof.

The ridge making tool is then used to form a pair of reinforcing ridges extending diagonally between opposite corners of the sheet metal. This step is accomplished by laying the top to be formed on a resilient material, such as a piece of carpeting or cardboard, and then pressing the wheel of the tool into the sheet metal as the tool is rolled along each diagonal. The resilient material serves to absorb some of this impact resulting in the bending of the sheet metal into a uniform and clean ridge along each diagonal.

The bending tool is then used to bend both long edges and short edges along each respective second crease so that four sides are formed that extend substantially perpendicular to the remainder, or what is now the top portion of the chase top. Specifically, the edges are inserted between the horizontal portions of the clamping members, after which a rigid tool such as a pry bar is inserted between the vertical portions thereof. Pressure is then applied to the pry bar so that the horizontal clamping portions move together pinching the metal along each second crease, whereby further pressure results in the bending of the sheet metal there along. It will be understood that cuts are necessary in each corner of the sheet metal to facilitate the bending of the sides. A suitably dimensioned hole can than be cut into the chase top for extension there through of the chimney flue for ultimate placement of the top on the flue housing.

It will be appreciated by those of skill, that the first crease results in an outward flaring of the bottom of each side edge which skirt area provides for a drip edge when the top is in position on the chimney. Furthermore, such edge is straight and precise and provides for a chase top having the desired look and finish. In addition, the reinforcing edges also have the desired appearance qualities as well as serving to strengthen and reinforce the top, and to create a tenting effect enhancing the water run-off properties of the finished top. It can thus be understood, that the tools and method of the present invention provide for the making of chase tops in a manner that is quick, inexpensive, and that produces tops of high quality.

DESCRIPTION OF THE DRAWINGS

A more complete understanding of the structure and operation of the tools and method of the present invention can be had by review of the following detailed description which refers to the following drawing, wherein:

FIG. 9 shows a perspective view of a pair of bending tools of the present invention coupled together.

FIG. 10 shows a sheet metal workpiece for the purpose of facilitating the understanding of the operation of the tools and method of the present invention.

FIG. 11 shows a completed chase top for purposes of facilitating the understanding of the operation of the tools and method of the present invention.

DETAILED DESCRIPTION OF THE PREFERRED EMBODIMENTS

Figure 1:
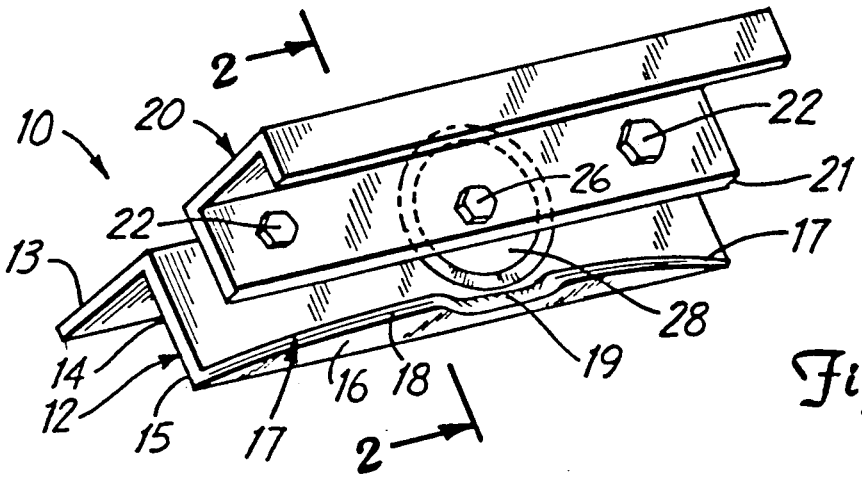
FIG. 1 shows a perspective view of the drip edge tool of the present invention.
Figure 2:
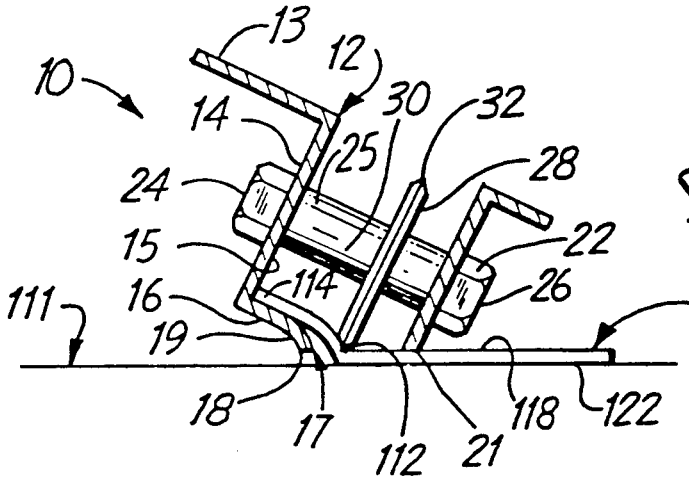
FIG. 2 shows cross sectional view of the drip edge tool along lines 2—2 of FIG. 1 with a sheet metal workpiece inserted therein.

The drip-edge or first creasing tool of the present invention is seen in FIGS. 1 and 2 and generally indicated by the number 10. Tool 10 includes a rigid member 12 having an upper horizontal handle portion 13 extending from an intermediate vertical portion 14 having an inner guide surface 15, and a lower horizontal support lip 16 also extending from vertical portion 14. Lip 16 includes an edge 17 that is rounded or cut on a radius which terminates with a pointed or beveled edge 18, and which includes a downwardly turned portion 19. Tool 10 also includes a U-shaped member 20 having a guide end 21, is held in a fixed spaced-apart relationship with member 12 by a plurality of spacer means, such as by bolts 22, lock nuts 24 and tubular spacers 25 extending around the portion of the shafts of bolts 22 extending between members 12 and 20. A hardened steel cutting wheel 28, such as used for cutting pipe and the like, is rotatively secured around the shaft of centrally located bolt 26, and includes a hub portion 30. Disk 28 is positioned so that the peripheral edge 32 thereof is located outwardly of edge 17 and that rotates through a plane substantially perpendicular to that of lip 16.

Figure 3:
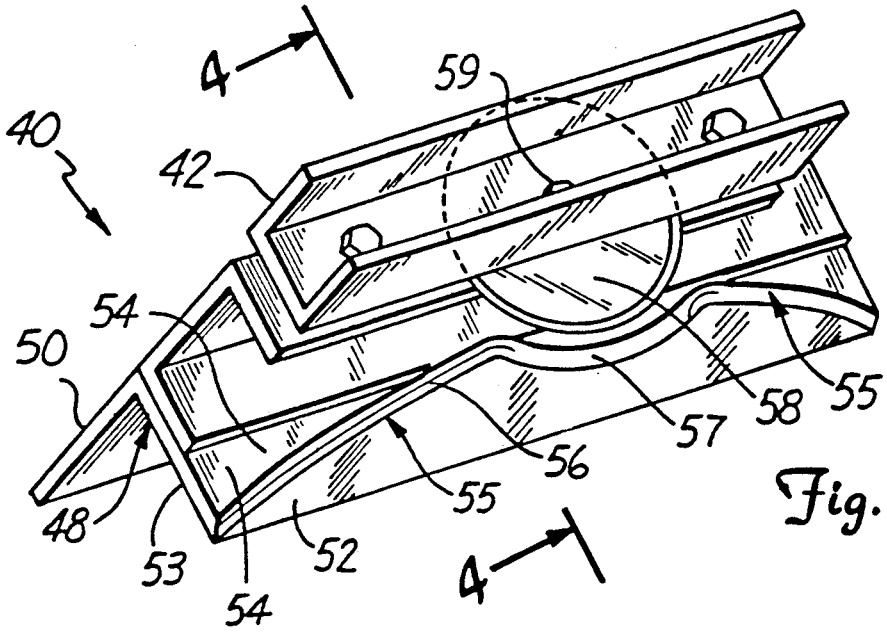
FIG. 3 shows a perspective view of the corner edge creasing tool of the present invention.
Figure 4:
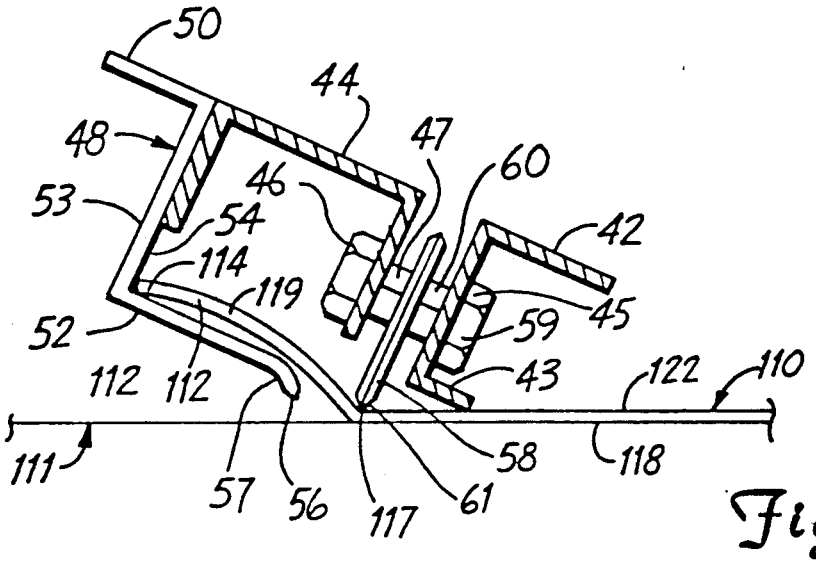
FIG. 4 shows a cross-sectional view of the corner edge creasing tool along lines 4—4 of FIG. 3 with a sheet metal workpiece inserted therein.

The corner-edge or second creasing tool of the present invention is seen in FIGS. 3 and 4, and generally indicated by the number 40. Tool 40 includes a first handle member 42, having a guide flange 43 extending therefrom, secured to a U-shaped extension member 44 by a plurality of rigid spacer means, such as bolts 45, lock nuts 46 and tubular spacers 47. Member 44 is integral with a rigid member 48 having an upper horizontal handle portion 50, a support lip 52 and a vertical portion 53 extending there between having an inner guide surface 54. Support lip 52 includes an outer edge 55 that is rounded or cut on a radius and terminates with a pointed or beveled edge 56, and includes a downwardly turned portion 57. A hardened steel cutting wheel 58, such as used for cutting pipe and the like, is rotatively secured around the shaft of centrally located bolt 59, and includes a hub portion 60. Disk 58 is positioned so that the peripheral edge 61 thereof is located outwardly of edge 56 and that rotates through a plane substantially perpendicular to that of lip 52.

Figure 5:
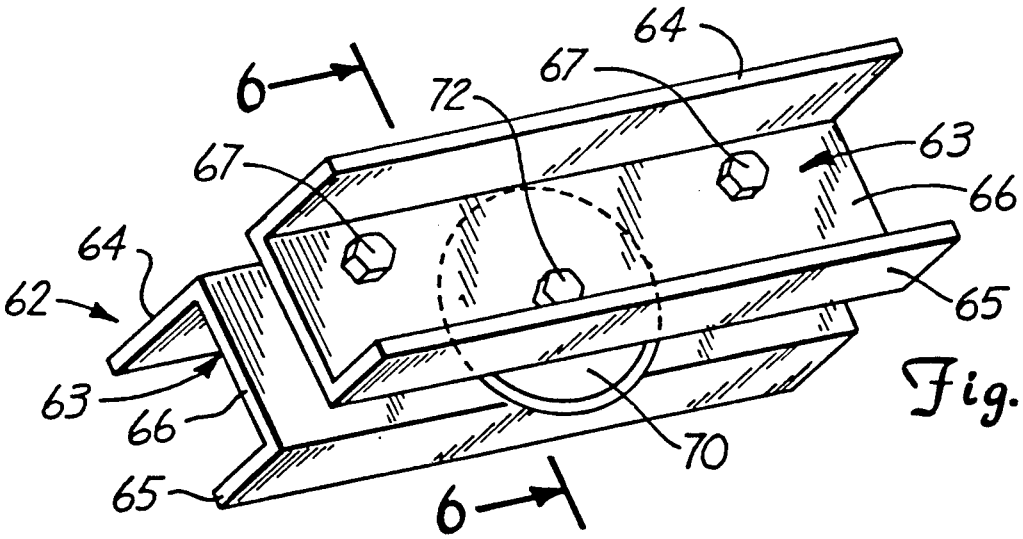
FIG. 5 shows a perspective view of the reinforcing ridge making tool of the present invention.
Figure 6:
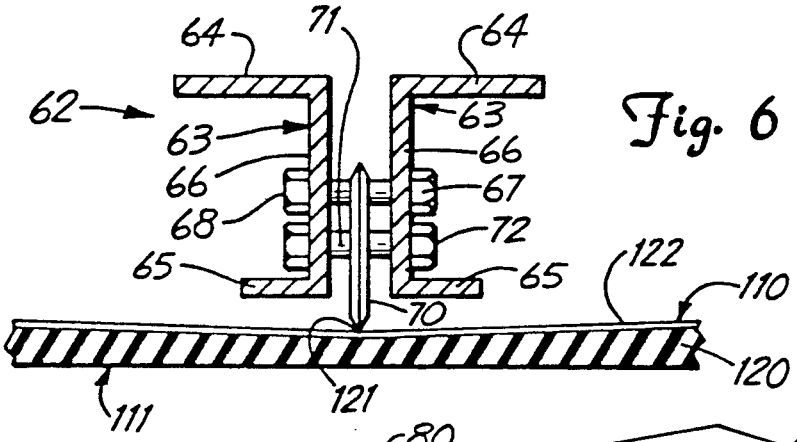
FIG. 6 shows a cross-sectional end view of the reinforcing ridge making tool along lines 6—6 of FIG. 5 in position over a sheet metal workpiece and a matting material.

The reinforcing ridge making tool of the present invention is seen in FIGS. 5 and 6, and generally referred to by the number 62. Tool 62 includes a pair of opposed rigid U-shaped handle members 63 having upper horizontal handle portions 64, lower horizontal flange portions 65 and vertical portions 66 extending there between. Handle members 63 are held in a fixed, spaced-apart position by a plurality of spacing means, such as bolts 67 extending through vertical portions 66, lock nuts 68 and tubular spacers 69. A hardened cutting wheel or disk 70, such as used for cutting metal pipe, and the like, includes a hub portion 71, and is rotatively secured to center bolt 72. Wheel 70 extends below flanges 65, and rotates through a plane substantially perpendicular thereto.

Figure 7:
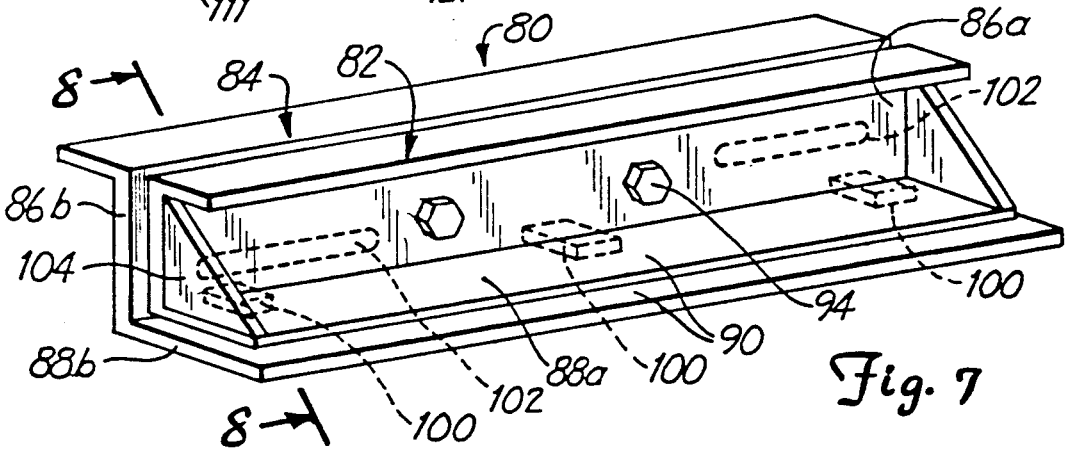
FIG. 7 shows a perspective view of the bending tool of the present invention.
Figure 8:
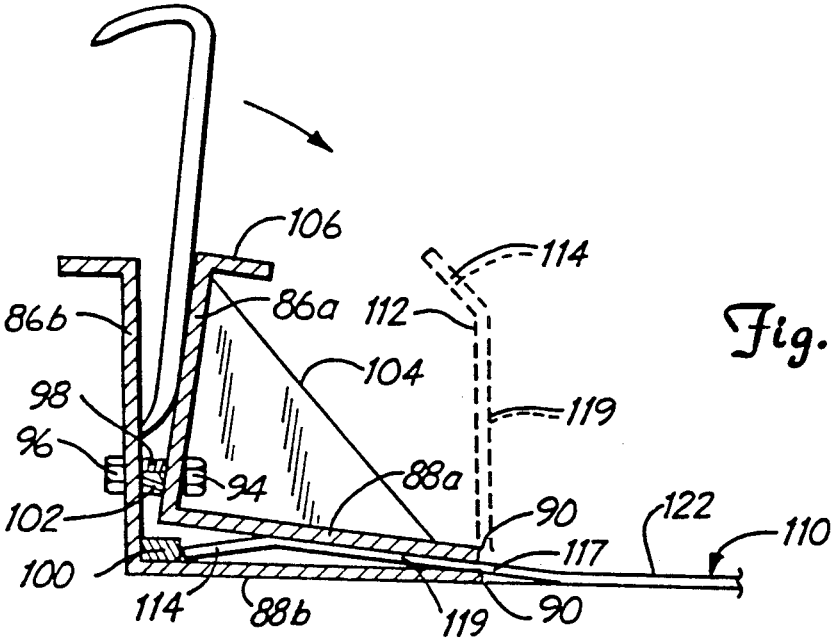
FIG. 8 shows a cross-sectional view of the bending tool of the present invention along lines along lines 8—8 of FIG. 7, along with a sheet metal workpiece and pry bar inserted therein.

The bending tool of the present invention is seen if FIGS. 7, and 8, and is generally referred to by the number 80. Tool 80 includes an outer L-shaped member 82 and a lower L-shaped member 84. Members 82 and 84 include vertical wall portions 86*a* and 86*b*, and horizontal clamping portions 88*a* and 88*b* respectively. Clamping portions 88*a* and 88*b* terminate with elongate clamping ends 90. Members 82 and 84 are flexibly held together by a plurality of biasing spacing means, consisting, for example, of a bolt 94, lock nut 96 and a spring 98 extending around the shaft of bolt 94, and located thereon between the vertical wall portions 86*a* and 86*b* of members 82 and 84. Lower member 82 includes a plurality of workpiece stops 100 integral therewith on the inner surface of clamping portion 88*a* adjacent vertical portion 86*a*. Member 88*a* also includes a pair of rounded elongate fulcrums 102 integral with the inner surface of vertical portion 86*a*, at a level thereon adjacent to horizontal clamping portion 88*a* and at a level equivalent with that of the biasing spacing means. Triangular reinforcing pieces 104 are integral with outer member 86*b* at opposite ends thereof and cooperate with over-hanging edges 106 to provide for added structural strength of member 82.

The operation of creasing tool 10 can be understood by also referring to FIG. 10, wherein a workpiece 110 of sheet metal is shown lying on a flat ground surface 111. Specifically, Tool 10 serves to put a uniform and straight crease, such as, for example, is indicated by lines 112 around the perimeter of a workpiece, such as 110, wherein a flange area 114 extending outwardly of crease 112 and terminating with a perimeter edge 116, is also formed. This flange formation is accomplished by extending tool 10 along each of the four perimeter edges 116, starting from each corner of workpiece 110. In particular, flange area 114 is supported on lip 16 during such extension, while tool 10 is simultaneously rotated along its elongate axis in the direction as indicated by the arrow in FIG. 2. Thus, the extension of tool 10 along edges 116 results in the bending upwardly of flanges 114 from the plane of originally flat workpiece 110 as tool 10 is simultaneously rotated during such extension. This bending is immediately followed, and enhanced by, the forming of a precise crease to properly define the flange area and provide for additional bending thereof, as the perimeter 30 of wheel 28 indents or presses downwardly into surface 118 toward floor surface 111, as it rolls there along. It will be appreciated that the perimeter edge 116 of workpiece 110 is initially substantially flush with surface 15 and pulls slightly away therefrom as flange area 114 is formed. In addition, edge 116 serves as a guide for the straight and linear extension of tool 10 as guide surface 15 initially contacts surface edge 116 and is moved there along. Moreover, contact end 21 will serve to define the limit of rotation of tool 10 and serves to guide tool 10 as end 21 contacts workpiece 110. The radius cut of lip 16 allows for the gradual lifting or relief of the sheet metal along the leading edge thereof ahead of tool 10, as tool 10 is pushed along each edge thereof so as to reduce the effort needed to push tool 10. Without such radial profile of the perimeter of lip 16, workpiece 110 would be lifted at too severe an angle along the length thereof ahead of wheel 28 resulting in increased friction and binding. The fact that lip 16 is cut on a radius along its entire length allows tool 10 to be used in either direction facilitating its use by right or left-handed individuals. Edge 18 is beveled so as to protect the floor surface 111 from any scratching damage. The operation of creasing tool 40 is the same as that described for tool 10. Tool 40 differs from that of tool 10 primarily in that lip 52 thereof is wider than that of lip 16, i.e. the space between peripheral wheel edge 61 and guide surface 54 is greater than that between guide surface 15 and wheel edge of tool 10. Thus, a crease line can be made at a greater distance from the perimeter edge of a sheet metal workpiece, such as demonstrated by lines 117 in FIG. 10, forming a second flange area 119. Thus, tool 40 is simultaneously extended along perimeter edge 116 while rotated about its elongate axis, as is indicated by the arrow in FIG. 4, to form flange area 119. Downwardly turned lip portions 19 and 57 serve to permit continuous operation of tools 10 and 40, wherein each tool can be rotated 90 degrees upon arriving at each corner and extended along the next edge. This mode of operation is more convenient than having to go off the workpiece at each corner and then re-inserting the workpiece in the tool to crease the following edge. Also, guide edge 21 and the tip end of guide flange 43 serve to contact the sheet metal and define the limits of rotation of tools 10 and 40, and serve to guide tools 10 and 40 along the surface of the workpiece.

The operation of reinforcing ridge tool 60 can be appreciated by referring to FIG. 4, wherein workpiece 110 is first laid upon a resilient or deformable matting 120, such as cardboard or carpeting. Pressure is applied downwardly in the direction of the arrow as tool 60 is rolled along the workpiece on wheel 72. Matting 120 will absorb this pressure resulting in the bending of the workpiece, such as lines 121 in FIG. 10, as the perimeter of wheel 72 indents or presses into surface 122.

The operation of bending tool 80 can be understood by reference to FIGS. 7 and 8, wherein the edge of the sheet metal workpiece such as edge 116 of workpiece 110, is inserted between horizontal clamping portions 88*a* and 88*b* up to stops 100. A leverage means, such as a pry bar 123 is then inserted between vertical portions 86*a* and 86*b*. Pressure is then applied to bar 123, in the direction as indicated by the arrows in FIGS. 7 and 8. This pressure will cause the vertical portion 86*a* of inner member 82 to rock against fulcrums 102 causing tip ends 90 to pinch or clamp workpiece 110 along a straight line defined by ends 90. Continued application of pressure in the direction indicated, will result in the bending of the workpiece along that line coextensive with ends 90. Workpiece 110 is shown in FIG. 8 in phantom, wherein the portion thereof inserted into tool 80 is bent into an upright position substantially vertical to the original plane thereof. Spring 90 serves to bias members 82 and 84 into the position as seen in FIG. 8, and to help maintain members 82 and 84 in the desired parallel and nestled orientation. As seen in FIG. 9, a pair of bending tools 80 can be linked together by a rigid bar 124 inserted between the respective inner and outer portions 86*a* and 86*b*, and 88*a* and 88*b* thereof and spanning a gap 126 there between. Thus, if the line along the workpiece is substantially longer than tool 80, two such tools can be coupled together in this manner and used to bend the workpiece through application of force to leverage means inserted, for example into both tools 80.

The method of forming a chase top according to the present invention can now be understood. A chase top, numbered 110' is seen in FIG. 11, and for purposes of this discussion will be understood to be workpiece 110 after manipulations thereto by the various tools described herein. Workpiece 110 is first laid flat on a suitable surface 111 with a side indicated as 118 facing upwardly, and its opposite side, indicated as 122, facing downwardly. Creasing tool 10 is then extended along each perimeter edge creating crease 112 which serves to form and define flange 114. The position of workpiece 110 is then reversed wherein side 118 is facing downwardly, after which creasing tool 40, is in a similar manner as with tool 10, extended along each perimeter edge forming crease line 117 and second flange area 119. Next, with a matting 120 underlying workpiece 110, tool 62 is used to form diagonal ridges 120 by extending tool 62 between opposite corners of workpiece 110. A straight edge laid upon surface 122 can be used to facilitate this step. Each of the four perimeter edges is then bent along crease lines 117 by tool or tools 80. In particular, edge 116 is inserted into a tool 80 between the vertical clamping portions 88*a* and 88*b* thereof up to the stops 100. Tool 80 is sized and the positions of stops 100 placed so that clamping ends 90 clamp directly along crease line 117. Thus, application of sufficient pressure to pry bar 123 will result in bending along crease line 117 so that second flange area 119 is substantially vertical with respect to the remainder of workpiece 110. It can be understood that such bending is facilitated by first cutting out portions of each corner to form flaps as is indicated by flap 130, shown in one such corner. In addition, chase tops are generally rectangular having two short sides and two long sides. It is preferable to bend the short sides first and then the long sides, thus having the flaps integral with the long sides to be ultimately wrapped around the corresponding vertical area 119 of each short side. By referring to FIG. 11, it can be appreciated by those of skill that second flange area 119 will thus form what can be described as the vertical cap edges of top 110', and flanges 114 will be in position to serve as a skirt or drip edge. Moreover, The diagonal ridges 121 serve to section top 110' into four separate triangular areas 132 defining a pyramidal area having an apex 134. As a result of this sectioning of the diagonal grooves or ridges pressed therein, top 110' is strengthened and reinforced. Also, as apex 134 is slightly higher than the corner edges, represented by lines 117, rain and the like will naturally run downwardly there from to edges 117, and downwardly from there to ultimately drip of edges 114 when top 110' is in place over a chimney flue. A central hole 136 can then be cut out of top 110' for extension there through of the chimney flue.

It can be understood that various modifications can be made to the tools and method of the present invention without exceeding the spirit and scope of the essential attributes thereof. For example, it can be understood that the tools described herein could be designed with unitary or integral handle members. In addition, it will be appreciated that such tools can be dimensioned, strengthened differently or made from materials other than rigid steel, and the like, for applications other than the bending of 24 or 26 gauge sheet metal typically used in the manufacture of chase tops. Also, creasing or indenting means other than wheels 28, 58 and 70, such as fixed hardened blades or cutting edges could be secured to appropriate positions on their respective handle members to provide for the needed indentation or creasing of the sheet metal. Moreover, the forming of a chase top is only illustrative of the uses of the tools herein, as such tools also have applications, for example, in the forming of sheet metal used in automobile body repair. For example, tool 60 can be used to place multiple parallel lines in the same side of a piece of sheet metal to create a curling effect therein to facilitate the forming of such a piece around or to a curved surface.

What is claimed is:

1. A method for forming chase tops from a substantially rectangular sheet metal workpiece having four perimeter edges, the method including the steps comprising: forming first crease lines along and inwardly of each perimeter edge of the workpiece and into a first side of the workpiece for defining drip edge areas between each first crease line and respective perimeter edge, forming second crease lines along each perimeter edge inwardly thereof and inwardly of each corresponding first crease line and into a second side of the workpiece opposite from the first side thereof for defining a vertical wall area between each first crease line and respective second crease lines, reinforcing the workpiece by indenting the workpiece along a line extending inwardly of the second crease lines for forming a reinforcing ridge into the workpiece, bending the workpiece along each second crease line so that the drip edge areas and the vertical wall areas extend transversely to the second side and in a direction opposite from the direction of the indenting of the reinforcing ridge.

2. The method as described in claim 1, and the step of reinforcing the workpiece comprising indenting the workpiece along diagonal lines extending between opposite corners of the workpiece, the diagonal lines formed into the workpiece second side.

3. The method as described in claim 1, and the including the step of cutting the corners of the workpiece to facilitate the bending along the second crease lines.

4. The method as defined in claim 1 and the first crease line formed with a creasing tool, the creasing tool having a body member, and the body member including an upper handle portion and having guide means below the handle portion for cooperating with a perimeter edge of the workpiece for guiding the creasing tool along the perimeter edge and the body member having support means integral there with and extending there from below the handle portion for supporting the workpiece as each first crease line is formed, a creasing means secured to the body member, and the creasing means having a peripheral edge for creasing the workpiece along each first crease line, and the peripheral edge extending adjacent the support lip and the peripheral edge extending through a plane transverse to the plane of extension of the support lip.

5. The method as defined in claim 1, and the second crease lines formed with a creasing tool, the creasing tool having a body member, and the body member including an upper handle portion and having guide means below the handle portion for cooperating with a perimeter edge of the workpiece for guiding the creasing tool along the perimeter edge and the body member having support means integral there with and extending there from below the handle portion for supporting the workpiece as each second crease line is formed, a creasing means secured to the body member, and the creasing means having a peripheral edge for creasing the workpiece, and the peripheral edge extending adjacent the support lip and the peripheral edge extending through a plane transverse to the plane of extension of the support lip.

6. The method as defined in claim 1, and the reinforcing ridge formed with a reinforcing tool, the reinforcing tool having a body member including an upper handle portion and a support portion integral with the handle portion and extending downwardly therefrom to a bottom edge, and a ridge making means secured to the support portion and the ridge making means having a peripheral edge extending below the bottom edge.

7. The method as defined in claim 1, and the bending along the second crease line accomplished using a bending tool, the bending tool including an outer member and a lower member, the outer and lower members flexibly secured together by a plurality of fastening means, and the outer and lower members each having upwardly extending rigid wall portions for receiving a leveraging tool there between, and each member having clamping portions integral with their respective wall portions and extending therefrom at a transverse angle and terminating with elongate clamping ends for clamping the workpiece inserted between the clamping portions along the desired second crease line.

8. A method for forming chase tops from a substantially rectangular sheet metal workpiece having four perimeter edges, the method including the steps comprising: forming corner edge crease lines along and inwardly of each perimeter edge of the workpiece and the corner edge crease lines extending into a first side of the workpiece for defining vertical wall areas between each corner edge crease and respective perimeter edge, reinforcing the workpiece by indenting the workpiece along a line extending inwardly of the corner edge crease lines for forming a reinforcing ridge into the workpiece the reinforcing ridge extending into the workpiece first side, bending the workpiece along each corner edge crease line so that the vertical wall areas extend transversely to the first side and in a direction opposite from the direction of the indenting of the reinforcing ridge.

9. The method as defined in claim 8, and including the step of forming drip edge crease lines along and between each corner edge crease line and each respective perimeter edge of the workpiece and into a second side of the workpiece opposite from the first for defining drip edge areas between each drip edge crease line and respective perimeter edge.

10. The method as defined in claim 9, and the drip edge crease lines formed with a creasing tool, the creasing tool having a body member, and the body member including an upper handle portion and having guide means below the handle portion for cooperating with a perimeter edge of the workpiece for guiding the creasing tool along the perimeter edge and the body member having support means integral there with and extending there from below the handle portion for supporting the workpiece as each drip edge crease line is formed, a creasing means secured to the body member and the creasing means having a peripheral edge for creasing the workpiece, and the peripheral edge extending adjacent the support lip and the peripheral edge extending through a plane transverse to the plane of extension of the support lip.

11. The method as described in claim 8, and the step of reinforcing the workpiece comprising indenting the workpiece along diagonal lines extending between opposite corners of the workpiece, the diagonal lines formed into the workpiece second side.

12. The method as defined in claim 8, and the including the step of cutting the corners of the workpiece to facilitate the bending along each corner edge crease line.

13. The method as defined in claim 8, and each corner edge crease line formed with a creasing tool, the creasing tool having a body member, and the body member including an upper handle portion and having guide means below the handle portion for cooperating with a perimeter edge of the workpiece for guiding the creasing tool along the perimeter edge and the body member having support means integral there with and extending there from below the handle portion for supporting the workpiece as each corner edge crease line is formed, a creasing means secured to the body member, and the creasing means having a peripheral edge for creasing the workpiece along each corner edge line, and the peripheral edge extending adjacent the support lip and the peripheral edge extending through a plane transverse to the plane of extension of the support lip.

14. The method as defined in claim 8, and the reinforcing ridge formed with a reinforcing tool, the reinforcing tool having a body member including an upper handle portion and a support portion integral with the handle portion and extending downwardly therefrom to a bottom edge, and a ridge making means secured to the support portion and the ridge making means having a peripheral edge extending below the bottom edge.

15. The method as defined in claim 8, and the bending along each corner edge crease line accomplished using a bending tool, the bending tool including an outer member and a lower member, the outer and lower members flexibly secured together by a plurality of fastening means, and the outer and lower members each having upwardly extending rigid wall portions for receiving a leveraging tool there between, and each member having clamping portions integral with their respective wall portions and extending therefrom at a transverse angle and terminating with elongate clamping ends for clamping the workpiece inserted between the clamping portions along the desired corner edge crease line.

* * * * *